US005655326A

United States Patent [19]

Levavi et al.

[11] Patent Number: 5,655,326

[45] Date of Patent: Aug. 12, 1997

[54] METHOD OF DEPLOYING A WEAPON UTILIZING THE "GLOCK SYSTEM" WHICH PROVIDES MAXIMUM SAFETY AND READINESS

[76] Inventors: Israel Levavi; Beatrice Levavi, both of 117 S. Gardner St., Los Angeles, Calif. 90036

[21] Appl. No.: 452,639

[22] Filed: May 25, 1995

[51] Int. Cl.[6] ..... F41A 17/00

[52] U.S. Cl. ..... 42/70.01; 89/196; 42/75.02

[58] Field of Search ..... 89/163, 196, 147; 42/70.01, 75.02

[56] References Cited

U.S. PATENT DOCUMENTS

| | | | |
|---|---|---|---|
| 1,376,165 | 4/1921 | Rosebush | 89/196 |
| 3,657,959 | 4/1972 | Kart | 89/196 |
| 3,696,706 | 10/1972 | Seidel et al. | 89/196 |
| 4,539,889 | 9/1985 | Glock | 89/147 |
| 4,825,744 | 5/1989 | Glock | 89/145 |
| 4,893,546 | 1/1990 | Glock | 89/145 |
| 5,325,617 | 7/1994 | Vojta et al. | 42/75.03 |

OTHER PUBLICATIONS

Glock Armorer's Manual, titled "Glock Semiautomatic Safe Action Pistols," pp. 5–37, Jan. 1992.

Peter Alan Kasler, "Glock:The New Wave in Combat Handguns," pp. 28–39 and 178–183, 1992.

*Primary Examiner*—Stephen M Johnson

*Attorney, Agent, or Firm*—A. M. Fernandez

[57] ABSTRACT

A method is disclosed for placing a semiautomatic pistol, such as a Glock pistol (or any other type of pistol having a recoiling slide on a frame for both loading another cartridge from a magazine and cocking the trigger mechanism of the pistol), in a condition of absolute safety for deployment. That new condition is with a cartridge in the chamber of the pistol and its trigger mechanism uncocked. The method is carried out by separating the slide from the frame of an uncocked pistol, partially disassembling the slide to place a round on the breech face of the chamber and reassembling the slide with the chambered end of the barrel over the cartridge. The slide is then replaced on the frame by drawing it back over a spring-loaded slide lock. The trigger mechanism may then be cocked when the pistol is deployed by drawing the slide back an extent necessary and sufficient for that purpose without engaging a mechanism for loading another cartridge in the chamber. Tactile and/or audible means are provided to indicate when the slide has been drawn back that necessary and sufficient extent to cock the trigger mechanism in the frame without inadvertently drawing it back so far as to load another round in the chamber. The pistol may thereafter be safely deployed and easily cocked for firing in a very quick motion by drawing the slide back that necessary and sufficient extent which is significantly less than necessary to load a round in the chamber, and with less force.

7 Claims, 2 Drawing Sheets

METHOD OF DEPLOYING A WEAPON UTILIZING THE "GLOCK SYSTEM" WHICH PROVIDES MAXIMUM SAFETY AND READINESS

FIELD OF THE INVENTION

The invention relates to the Glock semiautomatic pistol, and more particularly to a method of loading a cartridge in the chamber of the barrel without cocking its trigger mechanism. The pistol may thereby be unholstered and handled under stress with absolute safety and be ready for firing with an ease and facility which, thus far, has never been described.

BACKGROUND OF THE INVENTION

The semiautomatic pistol disclosed by Gaston Glock of Austria in U.S. Pat. Nos. 4,539,889, 4,825,744 and 4,893,546 has many distinguishing features. The Glock system represents a radical departure from the non in semiautomatic pistols in terms of design and mechanics. Shortly after the introduction of the Glock pistol, thousands of Federal, State and local law enforcement agencies issued or authorized Glock pistols for duty use; hundreds of thousands came into use in North America in the private sector as well.

The impressive adoption of the Glock semiautomatic pistol which currently is available in several calibers is attributable to its exemplary performance in testing as well as to the perception that the deployment of this weapon will provide an edge in combat situations which cannot be matched by other systems.

Among the advantages of the Glock system are: (1) fewer moving parts; (2) simple disassembly; (3) simple reassembly; (4) durability; (5) lightness achieved by maximum use of polymer; (6) simple operation; and (7) extreme reliability.

It is not surprising the Glock pistols—and the recently introduced Sigma pistol by Smith & Wesson—have taken a large segment of the handgun market by storm. In October of 1990, a Miami police officer captured the world title of I.P.S.C. World Stock Gun Championship with a Glock 17L competition model. In summary, Glock pistols, which incorporate a double-action trigger safety, are easy to use, reliable, durable and accurate.

There are only three externally-located controls on Glock pistols: (1) a slide release lever; (2) a magazine release button; and (3) a safe-action trigger system.

The safety features of the Glock pistol which will now be described relate to its safe-action trigger system and firing pin.

(1) There is a subtrigger or safety lever protruding through the front face of the trigger itself. When the trigger finger depresses the trigger system, the safety lever is contacted first and is depressed until it becomes flush with the face of the trigger, thereby unlocking the trigger so that it may be pulled to the rear in order for the gun to be fired.

(2) A firing pin safety blocks the firing pin until the trigger is pulled completely to the rear.

(3) A drop safety prevents the pistol from firing if it is dropped (the drop safety is disarmed as the trigger is pulled fully to the rear).

(4) The striker assembly is not fully enabled until the trigger is pulled completely to the rear.

Despite its numerous advantages, the Glock system suffers from a glaring deficiency. That deficiency is the lack of an affirmative safety device, i.e., a safety device requiring some cognitive action before firing capability is achieved. Lack of a cognitive safety device makes for several potential disasters: (1) the weapon may be taken away from its owner and turned on him/her; (2) accidental discharge during holstering, unholstering or other handling is facilitated; and (3) a child or other unauthorized person may too easily discharge the firearm.

Prior attempts to address this glaring deficiency include the leaf-type "New York Trigger Spring" which replaces a coil-type trigger spring, thereby increasing the force necessary to pull the trigger fully to the rear and fire the weapon. Its main purpose is to alter the trigger mechanism to "feel" like the typical police-type revolver. Training programs for law enforcement agencies in the field of safe weapon retention systems also exist. However, none of these efforts have truly addressed the Glock pistol's intrinsic lack of an affirmative safety device, i.e., one requiring cognitive action before firing capability is achieved while maintaining a mode of deployment which keeps the gun in a complete state of safety and makes accidental discharge impossible.

Currently there are two conventional conditions or modes of deploying a Glock pistol:

(1) The chamber is empty and a full magazine is in place. When the pistol is unholstered and held in the strong hand, the weak hand embraces the slide, draws it back and the trigger is then fully cocked. When the slide is released, a round is chambered and, with the trigger fully cocked, the gun is ready to fire.

(2) A round is already chambered, the trigger is fully cocked and a full magazine is in place. When the pistol is unholstered, it is ready for semiautomatic operation by pulling the trigger, thus purposely or accidentally firing the first round already in the chamber.

SUMMARY OF THE INVENTION

The present invention provides a new, third mode or condition of deploying not only the Glock pistol with the safe-action trigger system but also the Sigma pistol as well as all other pistols that utilize the Glock pistol trigger system.

In this new condition, a round is in the chamber and the trigger is not cocked. There is no way to fire the weapon in this configuration. If a gun owner is disarmed and has his/her own gun turned on him/her, a pull on the trigger by the authorized user is futile. An accidental discharge is impossible. A child finding the weapon in this condition cannot fire the pistol by depressing the trigger. An additional benefit to this condition or mode of deployment with the trigger not cocked is that the spring is not under complete tension and there is therefore less spring fatigue. Also, a magazine in the pistol in this condition may be readily cycled in the usual manner to prevent magazine spring fatigue. An additional benefit is that not only is a "New York (hard pull) Trigger Spring" not necessary for safety but a lighter trigger (already a currently available after-market item) may be employed without compromising safety.

When the pistol is deployed utilizing the present invention, only ounces of force and less then two centimeters of slide travel are necessary to cock the trigger mechanism, rather than pounds of force and inches of slide travel required to cock the trigger and chamber a round as is required in the first of the two conventional conditions of deploying the Glock pistol noted above, i.e., in the condition of no round in the chamber and a loaded magazine in the pistol frame. Another advantage of this novel deployment is that readiness to fire is achieved much more quietly than the first of the two conventional conditions or modes of deploying a Glock pistol previously described above.

The achievement of this new third mode or condition of deployment is realized by the following steps:

(1) Removing the slide from the receiver on the frame of the pistol. The slide assembly comprises the slide (or carriage) itself, the breech face (through which a firing pin passes under the force of a spring when the cocked trigger is pulled to fire the gun), the gun barrel (with a chamber at the rear for receiving a cartridge with its flanged rear end against the breech face and its flange under the casing extractor, and a recoil spring and spring guide (for holding the chambered end of the barrel against the breech face).

(2) Removing the recoil spring and spring guide from the slide, thereby freeing the barrel.

(3) Moving the chambered end of the barrel away from the slide and slightly forward an extent equal to slightly more than the length of a cartridge, thereby exposing the breech face and providing space to manually insert a cartridge into the space previously occupied by the chamber when in position against the breech face.

(4) Placing the cartridge with its rear flanged end flat against the breech face and its flange under the extractor.

(5) Loading the cartridge in the chamber by moving the chambered end of the barrel back over the cartridge until it is seated against the breech face.

(6) Replacing the recoil spring and spring guide between an abutment at the front end of the slide and a lug on the chambered end of the barrel.

(7) And finally, replacing the slide thus assembled with a round in the chamber on the receiver of the pistol frame, thereby completing the process of placing the pistol in the new, third condition of deployment with a round in the chamber and the trigger not cocked.

When the pistol is deployed in this new, third condition, it can be easily and quickly cocked with the weak (nonshooting) hand by drawing the slide back less than two centimeters using ounces of force against the recoil spring, instead of pounds of force and inches of travel required to load a round in the chamber from the magazine and cock the trigger mechanism. To assure that the slide has traveled a necessary and sufficient distance to cock the trigger mechanism, but not so much as to cause sequelae chambering of a round in the chamber already holding a round, cooperating means are provided on at least the slide and permissibly on the receiver as well for causing the user to sense when the slide has traveled enough (less than about two centimeters) to only cock the pistol, such as protuberances on the slide and frame so spaced relative to each other that when they reach alignment the shooter will sense that the slide has been drawn back far enough, or a spring-loaded ball bearing in the slide so spaced from a recess in the receiver that when the recess in the ball bearing reaches the recess, or vice versa, tactile and audible sensing of that event occurs. The slide is then released and the recoil spring returns the slide to its forward position on the receiver ready for firing. Thus, a cognitive action is required before firing capability is achieved when deploying the pistol and a suitable means is provided for sensing when the slide has traveled enough to cock the trigger mechanism without any risk of so over drawing the slide as to jam the pistol by attempting to load another round in the chamber when one is already in the chamber.

To recapitulate, the invention consists of two aspects: a new mode of deployment, i.e., a method of preparing a Glock or Glock-type pistol in a new and safe condition with a round in the chamber but an uncocked trigger mechanism, and a means for alerting the user that the slide has been drawn to the rear sufficiently to cock the trigger mechanism so the user will release the slide and thus avoid attempting to chamber another round. The first aspect requires no additional hardware. The second aspect requires some means on the gun for indicating to a user when the slide has been drawn back sufficiently to cock the trigger mechanism and not substantially further.

The novel features that are considered characteristic of this invention are set forth with particularity in the appended claims. The invention may be best understood from the following description, particularly when read in connection with the accompanying drawings.

DETAILED DESCRIPTION OF THE INVENTION

Figure 1:
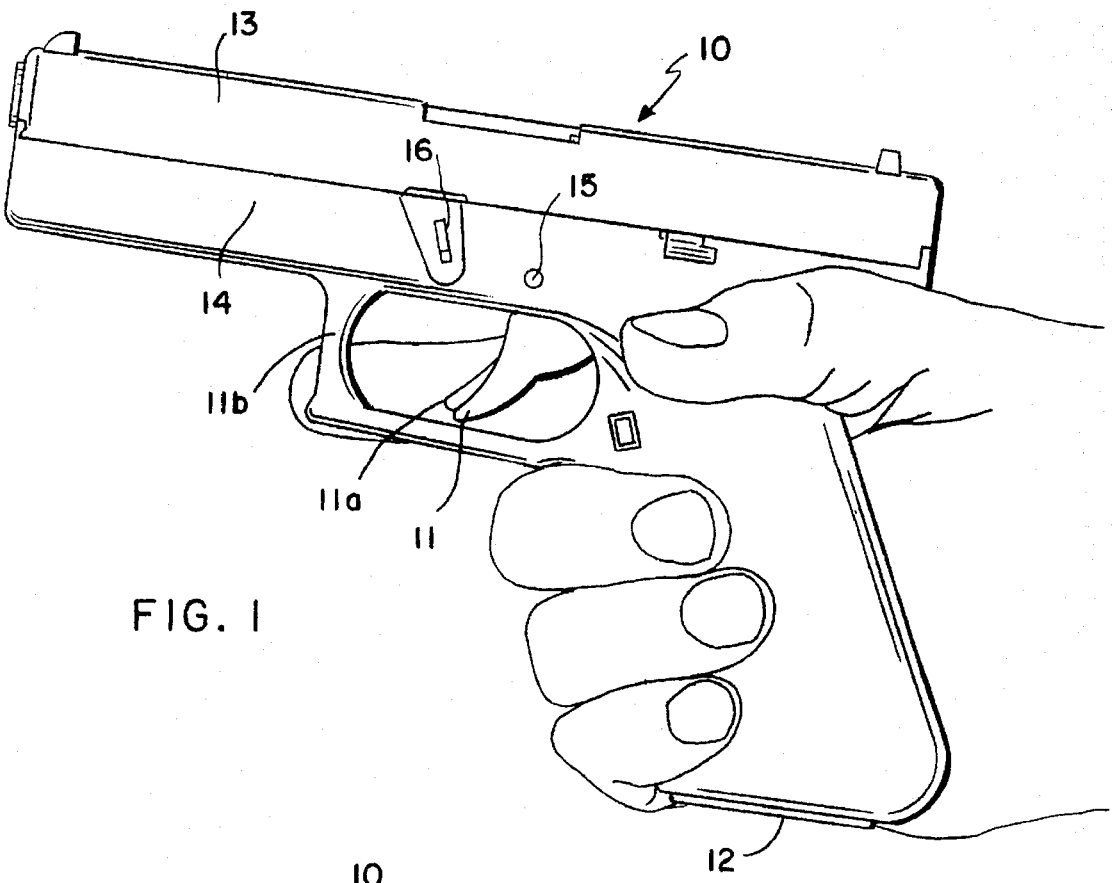
FIG. 1 illustrates a Glock semiautomatic pistol 10 deployed in the second conventional manner previously described above with its trigger 11 cocked, a round in its chamber and additional rounds in a cartridge magazine 12 such that the pistol is ready to be fired in the conventional semiautomatic mode.
Figure 2:
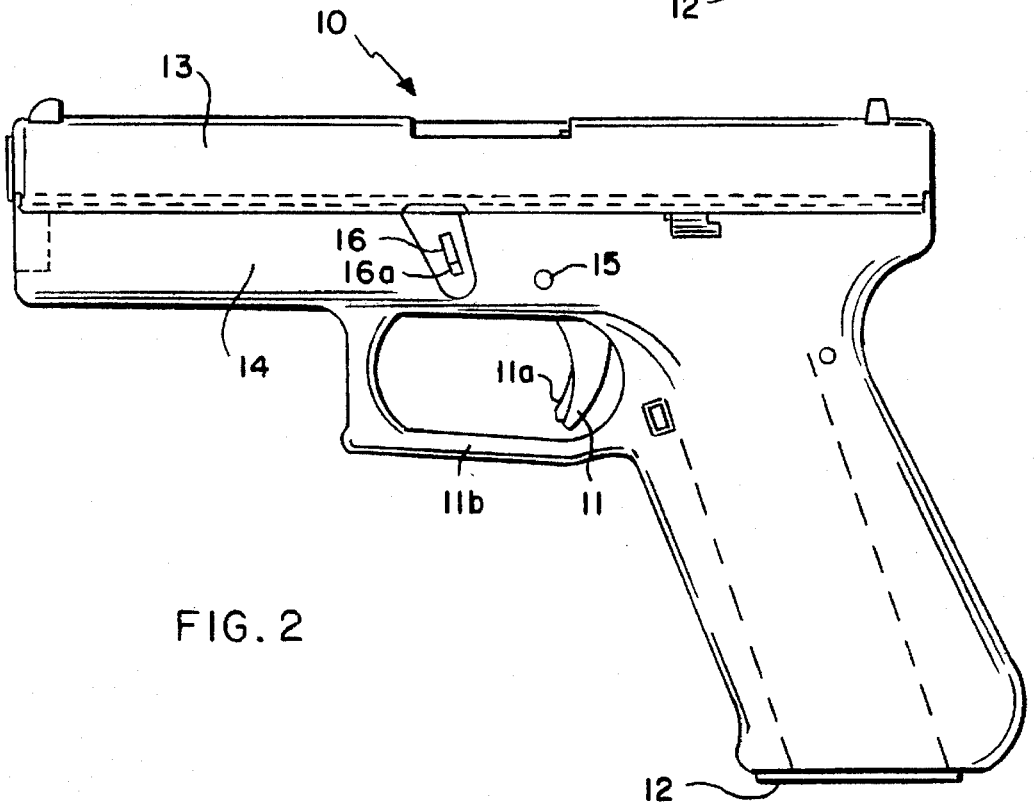
FIG. 2 illustrates the Glock semiautomatic pistol 10 of FIG. 1 in a condition in which it is to be deployed with its trigger 11 not cocked but a round in its chamber and additional rounds in the cartridge magazine such that the pistol is in a completely safe condition ready for use upon cocking the trigger by drawing its slide 13 to the rear on the receivers of the pistol frame 14 a necessary and sufficient distance significantly less than necessary for a round to be loaded into the pistol's chamber from the magazine 12. In addition less force is required to ready the novel configuration for firing than which is required for the second conventional condition described above.

The Glock automatic pistol illustrated in FIG. 1 is deployed in the second of the two conventional conditions of deploying the pistol noted above. The pistol has a safety lever 11*a* protruding from the trigger 11 while cocked, i.e., while the trigger is in its forward position. To fire a round after the trigger mechanism has been cocked, it is thus necessary to first pull the lever 11*a* to unlock the trigger, but that is a false safety because, if the pistol is deployed with the trigger finger improperly in the trigger guard 11*b*, the pistol may be accidentally discharged, sometimes with dire consequences to the user as the lever 11*a* can be easily pulled back to release the internal trigger safety mechanism. That internal trigger safety mechanism provides a measure of safety only against accidental discharge under certain circumstances not involving a finger or some object in the trigger guard, such as when the loaded and cocked pistol is dropped. Consequently, it is very important to deploy the pistol with the trigger finger extended outside the trigger guard as shown in FIG. 1 until the user is ready to start firing the loaded pistol.

The present invention provides cognizant, affirmative safety in the deployment of not only the Glock semiautomatic pistol illustrated as an example, but also other similar pistols having a slide mechanism for cocking the trigger when, prior to deployment, a round has been manually loaded in the chamber while leaving the trigger uncocked. This condition of a round in the chamber is highly desired because the force of several pounds and several inches of travel of the slide to load a round from the chamber requires too much effort and time before the first round can be fired, but as just noted the trigger safety of the Glock pistol does not prevent accidentally discharging the first round with the trigger finger, for example, upon unholstering the pistol for deployment of the weapon. Other semiautomatic pistols provide external safety devices such as a lever that can be set upon loading and cocking the pistol and then released with a flick of the thumb when the pistol is deployed; the user is then immediately ready to start firing the weapon. However, in the process of unholstering the pistol, one must be very careful not to accidentally release the safety which is a problem with semiautomatic pistols not having the internal safety of the Glock pistol described in U.S. Pat. Nos. 4,539,889, 4,825,744 and 4,893,546, and the GLOCK ARMORER'S MANUAL, titled *Glock Semiautomatic "Safe Action Pistols,"* (January 1992), which illustrates and describes procedures for disassembly and reassembly of the frame and slide mechanisms, which by these references are incorporated herein.

The first step of the procedure for placing the Glock pistol and other semiautomatic pistols in a condition of absolute safety is to remove the slide by drawing back the slide 13 then while pulling down on the slide lock 16 from both sides of the frame 14 simultaneously, thus releasing the slide. The recoil spring will propel the slide forward sufficiently for a locking block in the slide to clear the slide lock in the frame. Several techniques for separating the slide from the frame are known. The technique recommended by the *Glock Armorer's Manual* referenced above is to grasp the top of the slide with the strong hand (the right as shown in FIG. 1) with the thumb in the place there shown. Then placing the four fingers over the top of the slide, the slide is easily drawn back by the fingers, but first it is necessary to place the trigger 11 in the rearmost (uncocked) position in the usual manner employed to empty the pistol once the magazine has been removed. An alternative technique for drawing the slide back while pulling the slide lock down is to rotate the placement of the strong hand 180° and with the thumb still in the same place grasp the slide mainly with the index finger over the top of it to pull it back. The grasp made in this alternative way is stronger. In either case, the palm of the weak hand is placed under the trigger guard while the thumb and index finger of that weak hand pulls down on both ends of the slide lock 16 in slots 16*a* on both sides of the pistol of the frame 14. Both techniques are described by Peter Alan Kesler *GLOCK: The New Wave in Combat Handguns*, Paladin Press, pp. 179–182.

Figure 3:
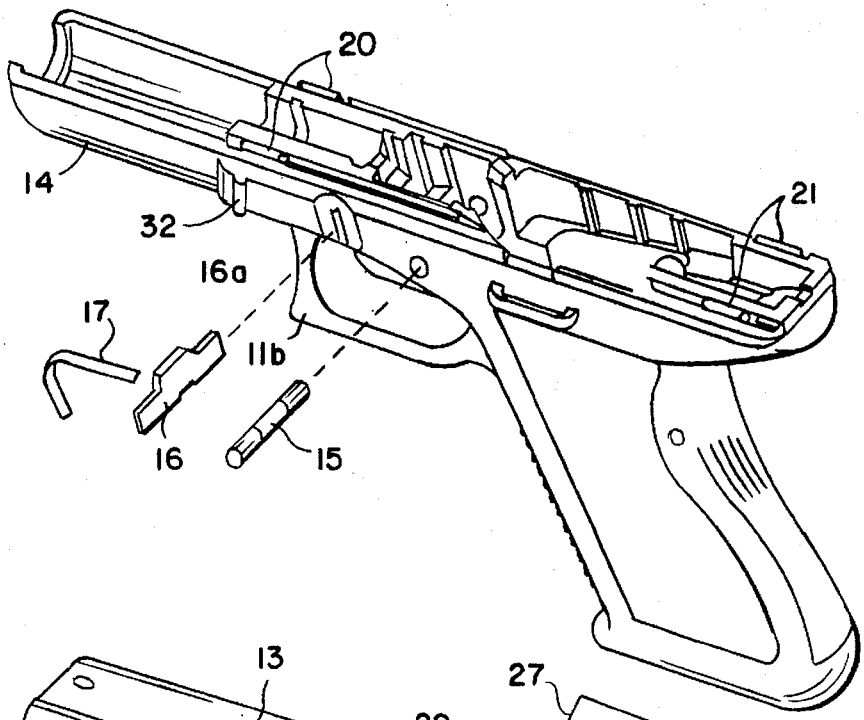
FIG. 3 illustrates the frame 14 of the Glock semiautomatic pistol with all of its mechanisms disassembled and not shown except for its trigger pin 15, spring-loaded slide lock 16 and its slide locking spring 17 to clearly show a set of two receivers 20 and 21, one set on each side of the frame 14 for receiving the slide 13 with the slide embracing the receivers on the frame.
Figure 4:
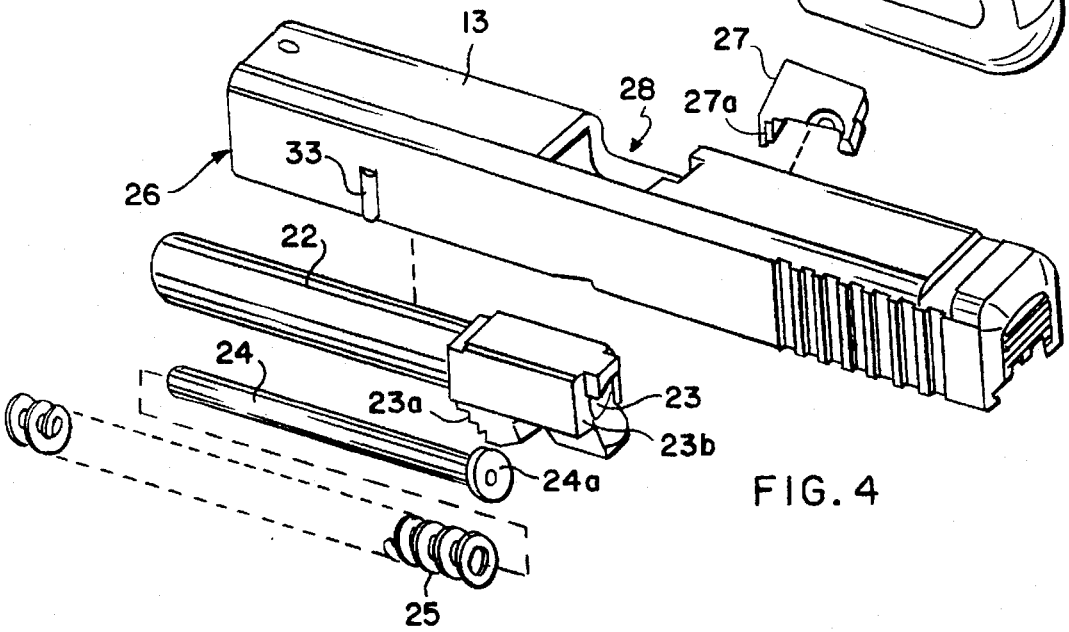
FIG. 4 illustrates the slide 13 with its mechanisms disassembled and not shown except for some pertinent parts, namely the gun barrel 22 having a rear chamber 23, a recoil spring-guide tube 24 and a recoil spring 25 that fits over the guide tube between an abutment 26 at the front of the slide 13 and a flange **24*a* on the rear of the spring-guide tube 24 with that flange seated in a half moon cut in the front of a barrel lug 23*a* under the chamber 23. Another pertinent part is an extractor 27 that is fitted inside the slide behind a port 28 in the slide 13 with an extractor hook 27*a* that fits over the flange of a cartridge to cause its casing to be extracted from the chamber and ejected through the ejection port 28**.

To proceed with the second step, once the slide 13 is separated from the frame 14 as shown in FIGS. 3 and 4 taken from an exploded drawing in the *Glock Armorer's Manual*, it is best to turn the slide over in the palm of the weak hand and using the thumb and index lift the recoil spring 25 and guide tube 24 out to free up the barrel 22 and then by grasping the lug 23*a* at the chambered end of the barrel, the chambered end is lifted slightly out of the slide so that it can be moved forward in the slide while it remains cradled in the slide. This exposes the breech face 29 (FIG. 5) in the slide so that in the fourth step a cartridge 30 may be placed with its flanged end flat against the breech block 23*b* with the flange between the extractor hook 27*a* and the breech face 29. The extractor hook 27*a* will help to hold the cartridge in place.

In the fifth step, once the cartridge 30 has been placed on the breech face 29, the lug 23*a* of the chambered end of the barrel is guided over the cartridge with the chamber 23 slipped over the cartridge until finally the upper side of the chambered end of the barrel, as shown in FIG. 4, seats in the upper part of the ejection port 28 of the slide. With the cartridge and barrel in place in the slide, the spring and spring guide are replaced conventionally.

Figure 5:
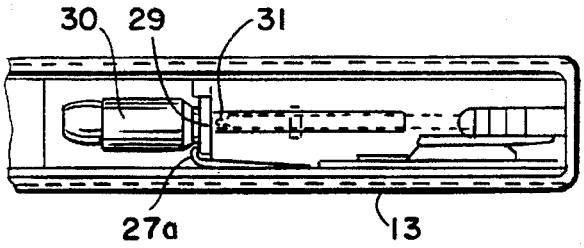
FIG. 5 is a view of the inverted rear portion of the slide 13, shown in FIG. 4, showing a cartridge 30 with its flange under the extractor hook **27*a* shown in its normal position. Once the pistol trigger system is cocked and the trigger is pulled, a firing pin 31 is propelled into the center of the primer at the flanged end of the cartridge 30, the recoil of the slide allows the extractor hook 27*a* to extract the spent casing of the cartridge 30 and eject it out of the port 28 shown in FIG. 4**.

In the final (seventh) step, the slide is returned to the frame 14 by sliding it back over the front of the frame 14 with the slide 13 embracing the sets of receivers 20 and 21 provided on both sides of the frame. The slide 13 forces the spring-loaded slide lock 16 down as the slide is drawn back over the slide lock 16. As the slide lock is thus cammed downwardly in the slots 16*a* on both sides of the frame and then returned by the spring 17, a tactile and audible indication is given that the slide is back and locked in place so that the pistol is now in its absolutely safe condition ready for deployment with a round in the chamber and the trigger mechanism not cocked as indicated in FIG. 5 by the firing pin 31 in its retracted position behind the breech face To cock the trigger mechanism, the slide is drawn back about 1.2 to 1.6 cm which is necessary and sufficient to cock the trigger without actuating the mechanism for loading a round into the chamber from the magazine 12. To assist the user in determining when the slide has been drawn back to the extent sufficient to cock the trigger, a protuberance 32 may be placed on both sides of the frame 14 that is about 1.6 cm behind a protuberance 33 on both sides of the slide. Alternatively, only one set of protuberances 32 and 33 is provided on the right side for right-handed users and on the left side for left-handed users, but preferably on both sides as just described above for left, right or ambidextrous users.

As the slide 13 is drawn back, the trigger finger extended along the side of the frame and slide feels the protuberance 32 on the frame but not the protuberance 33 on the slide which is further out from the pistol grip. When the protuberance 33 is felt by the trigger finger to be in alignment with the protuberance 32 as the slide 13 is drawn back to a position about 1.6 cm back, the slide is released. It should be noted that the index protuberance 32 on the slide may be sufficient by itself to signal the user that the slide has been drawn back sufficiently by impinging the end of the index finger extended along the slide.

Figure 6:
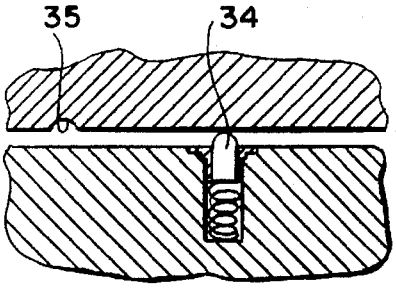
FIG. 6 illustrates an alternate means for indicating when the slide has been drawn back the necessary and sufficient extent to cock the trigger mechanism. The other means is shown as protuberances 32 and 33 on one or both sides of the respective frame 14 and slide 13, as shown in FIGS. 2, 3 and 4.

Another means of indicating when the slide has been drawn back the necessary and sufficient extent to cock the trigger mechanism comprises spring-loaded pin 34 having a spherical end protruding from a cylindrical recess just ahead of the trigger guard where the frame wall is thicker in one or both of the side walls of the frame 14 with the spherical end protruding sufficiently to engage the horizontal side of the slide wall as shown in FIG. 6. Engagement of the pin 34 with a groove 35 on the horizontal surface of the slide 13 will yield a tactile and audible indication that the slide has been drawn back sufficiently to cock the trigger. Still other arrangements for providing a tactile and/or audible indication of when the slide has been drawn back the necessary and sufficient extent will occur to those skilled in the art.

Although particular embodiments of the invention have been described and illustrated herein, it is recognized that modifications may readily occur to those skilled in the art. Consequently, it is intended that the claims be interpreted to cover such modifications and equivalents thereof.

What is claimed is:

1. A method for placing a semiautomatic pistol in a condition of absolute safety for deployment, said pistol having a frame with a trigger and a slide that carries a barrel with a cartridge chamber, a recoil spring and guide tube, a breech face and a firing pin, said method comprising the steps of separating said slide from said frame of said pistol with said trigger uncocked, partially disassembling said recoil spring and guide tube of said slide, then lifting the chambered end of said barrel slightly out of said slide to move it forward in said slide sufficiently to place a cartridge on said breech face of said slide, reassembling said recoil spring and guide tube of said slide with the axis of said chamber and barrel aligned with the axis of said cartridge, and reuniting said slide with said frame by sliding said slide over said frame an extent necessary to not only enclose said cartridge with said cartridge chamber but also engage a spring-loaded slide locking means, said trigger remaining uncocked until said slide is drawn back a further limited extent necessary and sufficient to cock a trigger mechanism in said frame without engaging a mechanism for loading a cartridge into said cartridge chamber, whereby said pistol may thereafter be safely deployed and easily cocked for firing in a very quick motion by drawing said slide back an extent less than necessary to load a cartridge in said chamber with less force.

2. A method as defined in claim 1 wherein said pistol includes means for indicating when said slide has been drawn further over said frame said limited and necessary extent sufficient to cock said trigger mechanism in said frame without inadvertently over-drawing said slide sufficiently to engage said mechanism for loading a cartridge into said cartridge chamber.

3. A method of placing a semiautomatic pistol in a condition of absolute safety for deployment, characterized by a cartridge in a chamber and a trigger system not cocked for safety in deploying said pistol achieved by the following procedure:

removing a slide from receivers on said pistol, said slide carrying a barrel with said chamber at a rear end thereof for receiving said cartridge;

removing a recoil spring and spring guide means from said slide, thus freeing said barrel from said slide;

moving the chambered end of said barrel slightly away from said slide and forward in said slide, thus tilting and repositioning said barrel to separate said chambered end of said barrel from a breech face in said slide by at least a distance equal to the length of said cartridge;

placing a cartridge having a flat flanged end against said breech face with its flange under an extractor hook provided as an integral part of said pistol to extract casings of spent cartridges automatically as each is fired sequentially in a semiautomatic mode;

moving said barrel back against said breech face by passing said chambered end of said barrel over said cartridge until seated against said breech face, thus loading said cartridge in said chamber of said barrel;

replacing said recoil spring and spring guide between an abutment at a front end of said slide and a lug on said chamber of said barrel; and replacing said slide thus reassembled on said receiver of said frame to complete the process of placing said automatic pistol in said condition of absolute safety for deployment with a cartridge in said chamber and said trigger system not cocked.

4. In a semiautomatic pistol placed in said absolutely safe condition for deployment as defined in claim 3, means for indicating when, in cocking said trigger of said pistol in said condition of absolute safety by drawing said slide rearwardly to cock said trigger system, the extent of slide travel being sufficient to cock said trigger but insufficient to place another cartridge from a magazine into said chamber.

5. A semiautomatic pistol as defined in claim 4 wherein said indicating means comprises a protuberance on at least one side of said slide, said protuberance on said slide being positioned in a forward portion on a side thereof where the user's trigger finger would normally not reach, thereby to provide tactile indication to said user that travel of said slide to the rear has been sufficient to cock said trigger system.

6. A semiautomatic pistol as defined in claim 4 wherein said indicating means comprises a first protuberance on at least one side of said slide and a second protuberance on at least one side of said receiver that is on a common side of said pistol as said first protuberance on said slide, said first protuberance on said slide being positioned on a forward portion of a side thereof where the trigger finger of said user would normally not reach, and said second protuberance on said side of said frame being placed in a position to the rear of said first protuberance on said slide a distance from said first protuberance equal to said minimal extent of slide travel, thereby to provide tactile indication to a user of the travel of said slide said sufficient extent for cocking said trigger system.

7. A semiautomatic pistol as defined in claim 4 wherein said indicating means is a ball bearing capture in a cylindrical recess in a selected one of said frame and said slide and a spring in said recess behind said ball bearing urging said ball bearing to partially protrude against the unselected one of said frame and slide to provide a tactile and audible indication when said slide has been drawn back over said frame to said minimal extent for cocking said trigger mechanism.

* * * * *